US007186100B2

(12) United States Patent
Cho et al.

(10) Patent No.: US 7,186,100 B2
(45) Date of Patent: Mar. 6, 2007

(54) VARIABLE CAPACITY ROTARY COMPRESSOR

(75) Inventors: Sung Hea Cho, Suwon (KR); Chun Mo Sung, Hwasung (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 259 days.

(21) Appl. No.: 10/811,897

(22) Filed: Mar. 30, 2004

(65) Prior Publication Data

US 2005/0053506 A1 Mar. 10, 2005

(30) Foreign Application Priority Data

Aug. 14, 2003 (KR) ..... 10-2003-0056360

(51) Int. Cl.
*F04C 29/02* (2006.01)
*F03C 2/00* (2006.01)

(52) U.S. Cl. ..... 418/94; 418/29; 418/60; 418/63; 417/221; 417/326; 184/6.16; 184/6.18

(58) Field of Classification Search ..... 418/94, 418/23, 39, 60, 63, 239, 29; 417/221, 326; 184/6.16, 618
See application file for complete search history.

(56) References Cited

U.S. PATENT DOCUMENTS 2,596,640 A * 5/1952 Berry ..... 418/88
3,311,292 A * 3/1967 Connor ..... 417/372
4,397,618 A 8/1983 Stenzel
4,472,114 A * 9/1984 Fujiwara et al. ..... 417/372
6,860,724 B2 * 3/2005 Cho et al. ..... 418/29

FOREIGN PATENT DOCUMENTS

JP 60030495 A * 2/1985
JP 61155688 A * 7/1986
JP 62271987 A * 11/1987
WO WO 01/16484 A1 3/2001

* cited by examiner

*Primary Examiner*—Theresa Trieu
(74) *Attorney, Agent, or Firm*—Staas & Halsey LLP

(57) ABSTRACT

A variable capacity rotary compressor allowing oil to be smoothly supplied to compressing elements, regardless of a rotating direction of a rotating shaft. The variable capacity rotary compressor includes a rotating shaft which is rotated in a forward direction or a reverse direction to vary a compression capacity of the compressor. A shaft bearing supports the rotating shaft. An oil guide groove is spirally formed on at least one of the shaft bearing and the rotating shaft to supply oil. An oil storing chamber is defined at an upper portion of the shaft bearing to communicate with the oil guide groove, and stores a predetermined amount of oil therein.

4 Claims, 9 Drawing Sheets

FIG. 1
(amended)
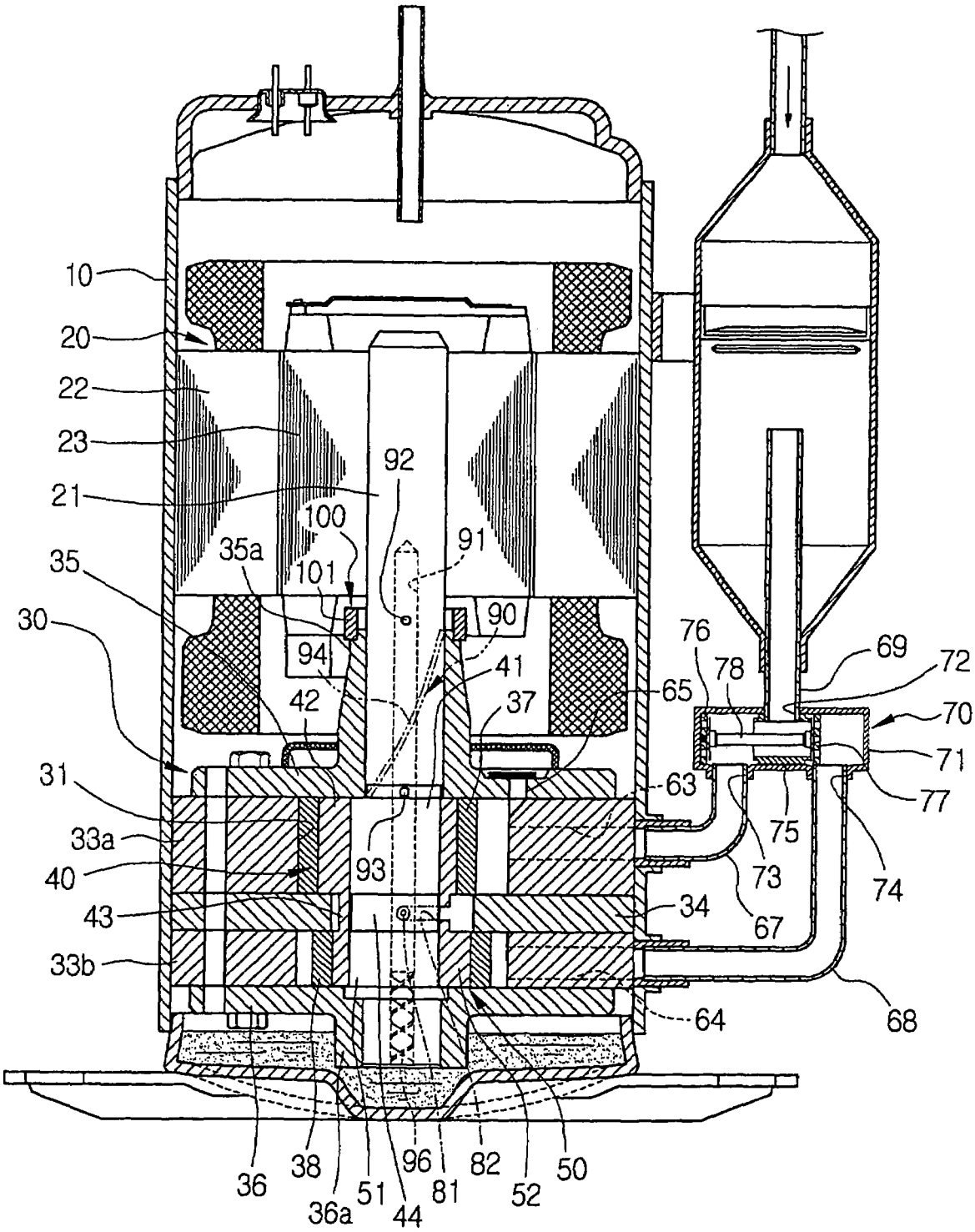

VARIABLE CAPACITY ROTARY COMPRESSOR

CROSS-REFERENCE TO RELATED APPLICATIONS

This application claims the benefit of Korean Patent Application No. 2003-56360, filed Aug. 14, 2003 in the Korean Intellectual Property Office, the disclosure of which is incorporated herein by reference.

BACKGROUND OF THE INVENTION

1. Field of the Invention

The present invention relates, in general, to variable capacity rotary compressors and, more particularly, to a variable capacity rotary compressor which allows a smooth supply of oil, regardless of a rotating direction of a rotating shaft.

2. Description of the Related Art

Recently, a variable capacity compressor has been increasingly used in a variety of refrigeration systems, such as air conditioners or refrigerators, so as to vary a cooling capacity as desired, thus accomplishing an optimum cooling operation and a saving of energy.

An earlier patent disclosure dealing with a variable capacity compressor is found in U.S. Pat. No. 4,397,618. According to the patent, a rotary compressor is designed to vary a compression capacity thereof by holding or releasing a vane. The rotary compressor includes a casing in which a cylindrical compression chamber is provided. A rolling piston is installed in the compression chamber of the casing to be eccentrically rotated. Further, a vane, designated as a "slide" in U.S. Pat. No. 4,397,618, is installed in the casing, and reciprocates in a radial direction while being in contact with an outer surface of the rolling piston. A vane holding unit, which includes a ratchet bolt, an armature, and a solenoid, is provided at a side of the vane to hold or release the vane, thus varying the compression capacity of the rotary compressor. That is, the vane is held or released in response to a reciprocating movement of the ratchet bolt controlled by the solenoid, thus varying the compression capacity of the rotary compressor.

However, the conventional variable capacity rotary compressor has a problem in that it is designed such that the compression operation thereof is controlled by holding or releasing the vane for a predetermined period of time, so it is difficult to precisely vary the compression capacity to obtain a desired exhaust pressure.

Further, the conventional variable capacity rotary compressor has another problem in that the ratchet bolt holding the vane is designed to enter a side of the vane and be locked to a locking hole formed at the vane, so it is not easy to hold the vane which reciprocates at a high speed when the compressor is operated, thus having poor reliability.

SUMMARY OF THE INVENTION

Accordingly, it is an aspect of the present invention to provide a variable capacity rotary compressor, which is designed to precisely vary a compression capacity to obtain a desired exhaust pressure, and to easily control an operation of varying the compression capacity.

It is another aspect of the present invention to provide a variable capacity rotary compressor, which allows oil to be smoothly supplied to compressing elements, regardless of a rotating direction of a rotating shaft.

The above and/or other aspects are achieved by a variable capacity rotary compressor including a rotating shaft which is rotatable in forward and reverse directions to vary a compression capacity of the compressor, a shaft bearing which supports the rotating shaft, an oil guide groove which is spirally formed on at least one of the shaft bearing and the rotating shaft to supply oil, and an oil storing chamber defined at an upper portion of the shaft bearing to communicate with the oil guide groove, and store a predetermined amount of oil therein.

The oil storing chamber has a larger inner diameter than an outer diameter of the rotating shaft to store the oil therein. The oil storing chamber may be defined by a ring-shaped oil storing member which is mounted at a lower portion thereof to the upper portion of the shaft bearing.

The oil storing chamber which stores the oil therein, may be defined by a large inner diameter part which is formed on the upper portion of the shaft bearing to have an increased inner diameter.

The rotating shaft may include an oil passage axially extending from a lower end to a predetermined position of the rotating shaft, and an oil supply hole formed on the rotating shaft in a radial direction to allow the oil passage to communicate with the oil guide groove via the oil supply hole, thus feeding oil from the oil passage to the oil guide groove.

The oil supply hole may be formed at a position corresponding to each of a lower end of the oil guide groove and the oil storing chamber.

The above and/or other aspects are achieved by a variable capacity rotary compressor including a rotating shaft, a shaft bearing which supports the rotating shaft, an oil guide unit provided on the rotating shaft to supply oil to frictional contact parts of the rotating shaft, and an oil storing chamber defined at an upper portion of the shaft bearing to store a predetermined amount of oil fed through the oil guide unit therein.

Further, the oil guide unit may include an oil passage axially extending from a lower end to a predetermined position of the rotating shaft, an oil supply hole formed on the rotating shaft to allow the oil passage to communicate with an outer surface of the rotating shaft via the oil supply hole, and an oil guide groove spirally formed on at least one of an inner surface of the shaft bearing and the outer surface of the rotating shaft.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 1 is a sectional view of a variable capacity rotary compressor, according to an embodiment of the present invention;

DETAILED DESCRIPTION OF THE EMBODIMENTS

Figure 2:
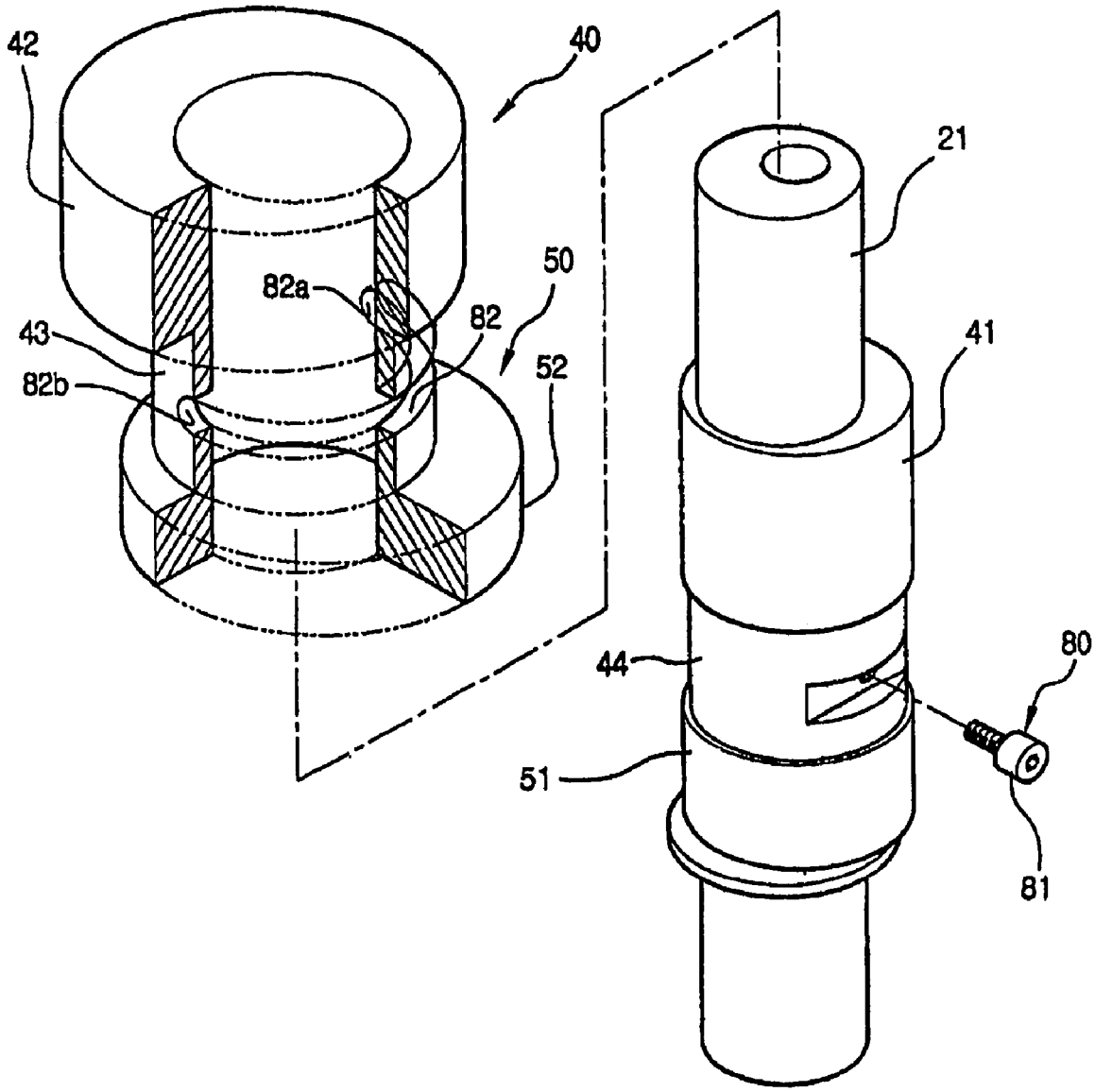
FIG. 2 is an exploded perspective view of an eccentric unit included in the variable capacity rotary compressor of FIG. 1.

Reference will now be made in detail to the embodiments of the present invention, examples of which are illustrated in the accompanying drawings, wherein like reference numerals refer to the like elements throughout. The embodiments are described below to explain the present invention by referring to the figures.

As shown in FIG. 1, a variable capacity rotary compressor according to the present invention includes a hermetic casing 10. A drive unit 20 is installed in the casing 10 to be placed on an upper portion of the casing 10. A compressing unit 30 is installed in the casing 10 to be placed on a lower portion of the casing 10, and is connected to the drive unit 20 through a rotating shaft 21. The drive unit 20 includes a cylindrical stator 22, and a rotor 23. The stator 22 is mounted to an inner surface of the casing 10. The rotor 23 is rotatably and concentrically set in the stator 22, and is mounted to the rotating shaft 21 which is placed at a center of the casing 10. The drive unit 20 rotates the rotating shaft 21 in a forward direction or a reverse direction.

The compressing unit 30 is provided with a housing. A first compression chamber 31 is cylindrical and is located at an upper portion of the housing. A second compression chamber 32 is also cylindrical but has a different capacity from the first compression chamber 31 and is located at a lower portion of the housing. The housing includes a first housing part 33*a* to house the first compression chamber 31, and a second housing part 33*b* to house the second compression chamber 32. An upper flange 35 is mounted to an upper surface of the first housing part 33*a* to close an upper portion of the first compression chamber 31, and a lower flange 36 is mounted to a lower surface of the second housing part 33*b* to close a lower portion of the second compression chamber 32. Further, a partition plate 34 is interposed between the first and second housing parts 33*a* and 33*b* to partition the first and second compression chambers 31 and 32 into each other. A cylindrical upper shaft bearing 35*a* upwardly extends from a center portion of the upper flange 35 to rotatably support an upper part of the rotating shaft 21. A cylindrical lower shaft bearing 36*a* downward extends from a center portion of the lower flange 36 to rotatably support a lower part of the rotating shaft 21.

As shown in FIGS. 1 to 4, first and second eccentric units 40 and 50 are mounted to the rotating shaft 21 to be placed in the first and second compression chambers 31 and 32, respectively. First and second rollers 37 and 38 are rotatably fitted over the first and second eccentric units 40 and 50, respectively. Further, a first vane 61 is installed between an inlet port 63 and an outlet port 65 of the first compression chamber 31, and reciprocates in a radial direction while being in contact with an outer surface of the first roller 37, thus performing a compression operation. A second vane 62 is installed between an inlet port 64 and an outlet port 66 of the second compression chamber 32, and reciprocates in a radial direction while being in contact with an outer surface of the second roller 38, thus performing a compression operation. The first and second vanes 61 and 62 are biased by vane springs 61*a* and 62*a*, respectively. Further, the inlet and outlet ports 63 and 65 of the first compression chamber 31 are arranged on opposite sides of the first vane 61. Similarly, the inlet and outlet ports 64 and 66 of the second compression chamber 32 are arranged on opposite sides of the second vane 62. Although not shown in the drawings in detail, the outlet ports 65 and 66 communicate with an interior of the hermetic casing 10 via a path defined in the housing.

The first and second eccentric units 40 and 50 include first and second eccentric cams 41 and 51, respectively. The first and second eccentric cams 41 and 51 are mounted to an outer surface of the rotating shaft 21 to be placed in the first and second compression chambers 31 and 32, respectively, while being eccentric from the rotating shaft 21 in a same direction. First and second eccentric bushes 42 and 52 are rotatably fitted over the first and second eccentric cams 41 and 51, respectively. As shown in FIG. 2, the first and second eccentric bushes 42 and 52 are integrally connected to each other by a cylindrical connecting part 43, and are eccentric from the rotating shaft 21 in opposite directions. Further, the first and second rollers 37 and 38 are rotatably fitted over the first and second eccentric bushes 42 and 52, respectively.

Figure 3:
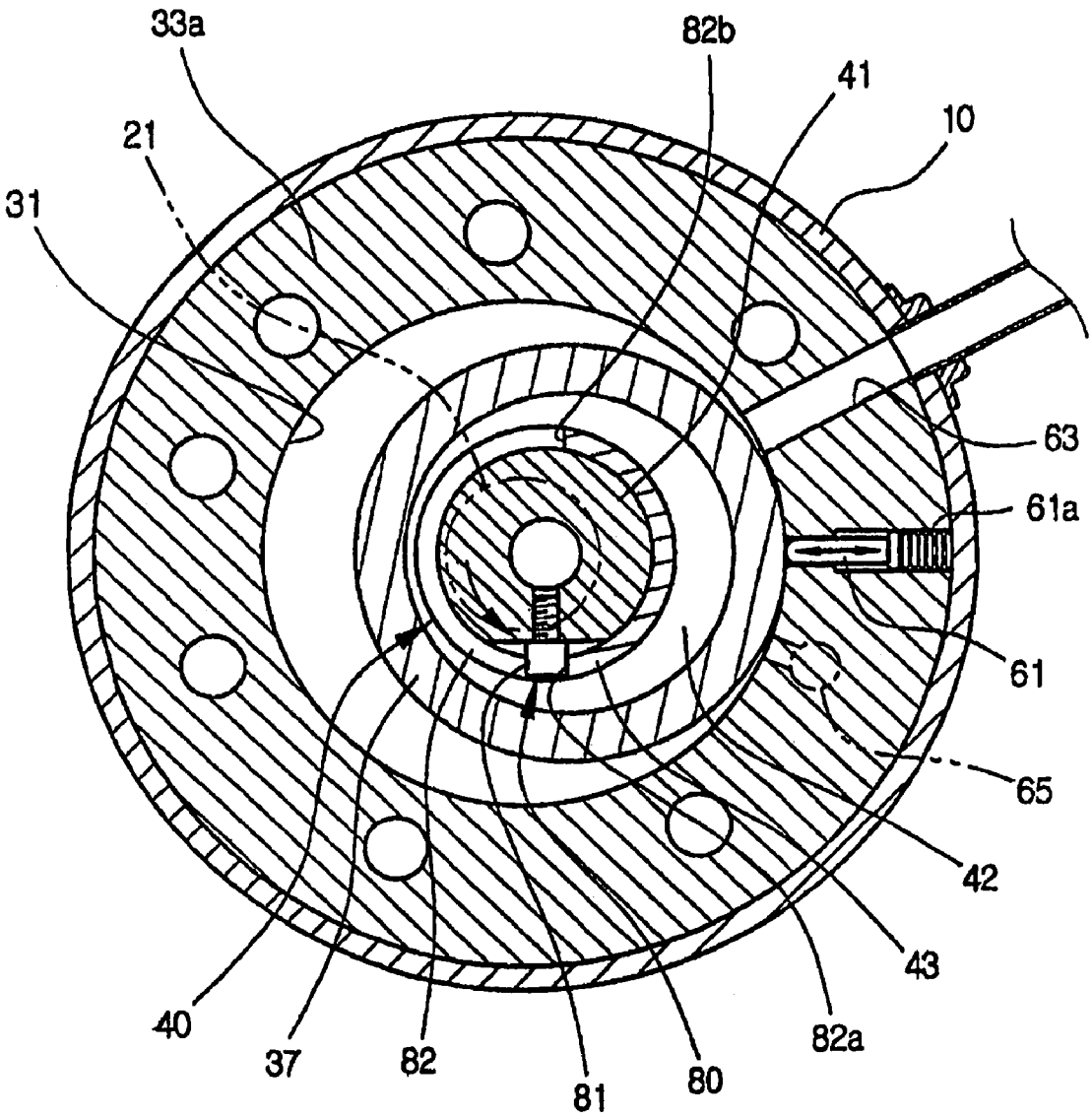
FIG. 3 is a sectional view of a first compression chamber where a compression operation is executed, when a rotating shaft of the variable capacity rotary compressor of FIG. 1 is rotated in a first direction.

As shown in FIGS. 2 and 3, an eccentric part 44 is mounted to the outer surface of the rotating shaft 21 between the first and second eccentric cams 41 and 51 to be eccentric from the rotating shaft 21 in a same direction of the eccentric cams 41 and 51. To the eccentric part 44 is mounted a locking unit 80. In this case, the locking unit 80 functions to make one of the first and second eccentric bushes 42 and 52 be eccentric from the rotating shaft 21 while releasing a remaining one of the first and second eccentric bushes 42 and 52 from eccentricity from the rotating shaft 21, according to a rotating direction of the rotating shaft 21. The locking unit 80 includes a locking pin 81 and a locking slot 82. The locking pin 81 is mounted to a surface of the eccentric part 44 in a connecting member fastening method to be projected from the surface of the eccentric part 44. The locking slot 82 is formed around a part of the connecting part 43 which connects the first and second eccentric bushes 42 and 52 to each other. The locking pin 81 engages with the locking slot 82 to make one of the first and second eccentric bushes 42 and 52 be eccentric from the rotating shaft 21. The engagement between the locking pin 81 and the locking slot 82 also causes a remaining one of the first and second eccentric bushes 42 and 52 to be released from eccentricity from the rotating shaft 21, according to a rotating direction of the rotating shaft 21.

When the rotating shaft 21 is rotated while the locking pin 81, mounted to the eccentric part 44 of the rotating shaft 21, and engaging with the locking slot 82 of the connecting part 43, the locking pin 81 is rotated within the locking slot 82 to be locked by either of locking parts 82*a* and 82*b* which are formed at opposite ends of the locking slot 82, thus making the first and second eccentric bushes 42 and 52 be rotated along with the rotating shaft 21. Further, when the locking pin 81 is locked by either of the locking parts 82*a* and 82*b* of the locking slot 82, one of the first and second eccentric bushes 42 and 52 is eccentric from the rotating shaft 21 and a remaining one of the first and second eccentric bushes 42 and 52 is released from eccentricity from the rotating shaft 21. Thus, a compression operation is executed in one of the first and second compression chambers 31 and 32 and an idle operation is executed in a remaining one of the first and second eccentric bushes 42 and 52. On the other hand, when a rotating direction of the rotating shaft 21 is changed, the first and second eccentric bushes 42 and 52 are arranged oppositely to the above-mentioned state.

Figure 4:
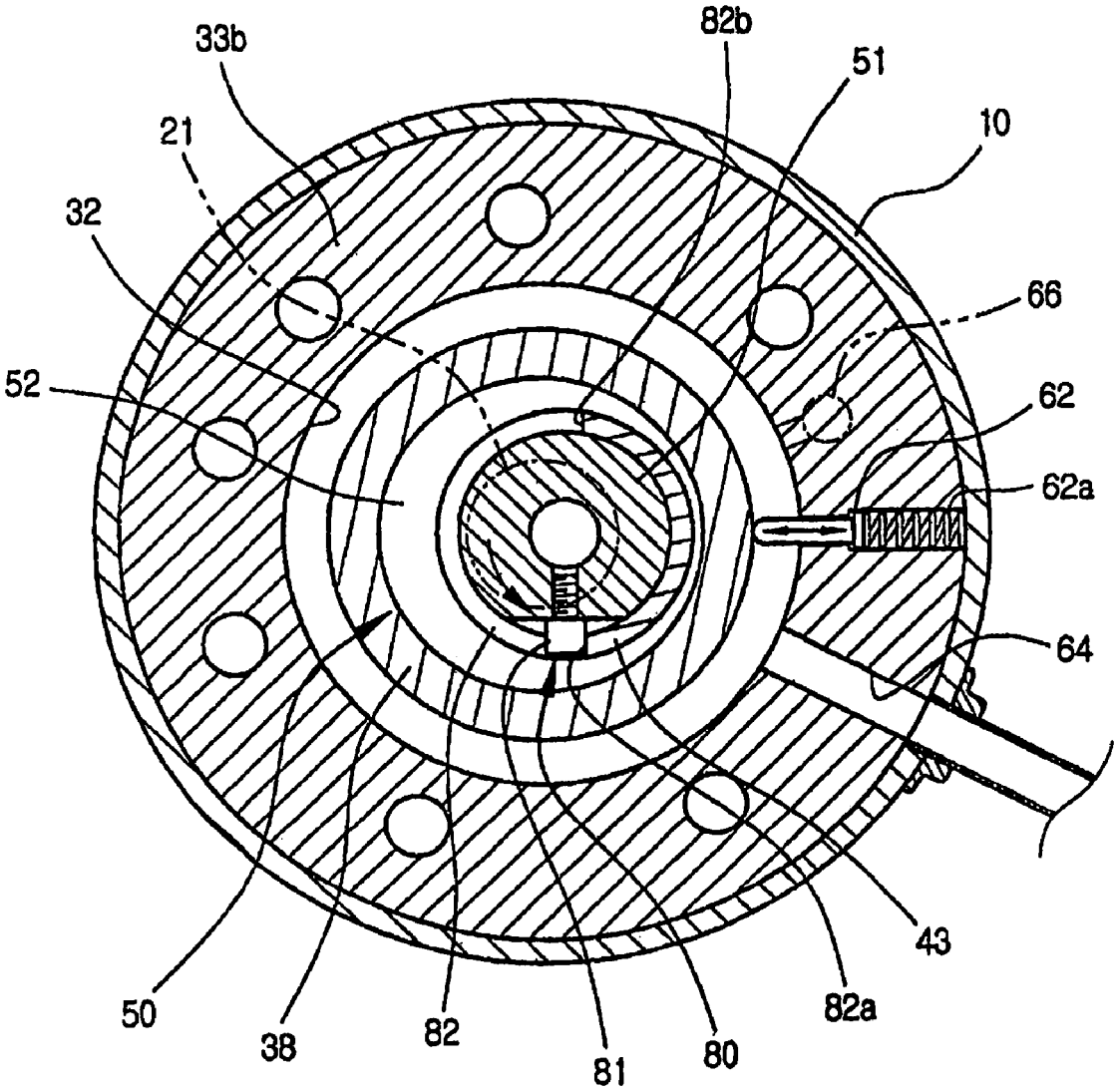
FIG. 4 is a sectional view of a second compression chamber where an idle operation is executed, when the rotating shaft of the variable capacity rotary compressor of FIG. 1 is rotated in the first direction.

The operation of the variable capacity rotary compressor is as follows. As shown in FIG. 3, when the rotating shaft 21 is rotated in either the counter-clockwise or clockwise directions, an outer surface of the first eccentric bush 42 in the first compression chamber 31 is eccentric from the rotating shaft 21 and the locking pin 81 is locked by the locking part 82*a* of the locking slot 82. Thus, the first roller 37 is rotated while coming into contact with an inner surface of the first compression chamber 31, thus executing the compression operation in the first compression chamber 31. At this time, the second eccentric bush 52 is arranged in the second compression chamber 32 as shown in FIG. 4. That is, an outer surface of the second eccentric bush 52, which is eccentric in a direction opposite to the first eccentric bush 42, is concentric with the rotating shaft 21, and the second roller 38 is spaced apart from an inner surface of the second compression chamber 32, thus an idle rotation is executed in the second compression chamber 32.

Figure 5:
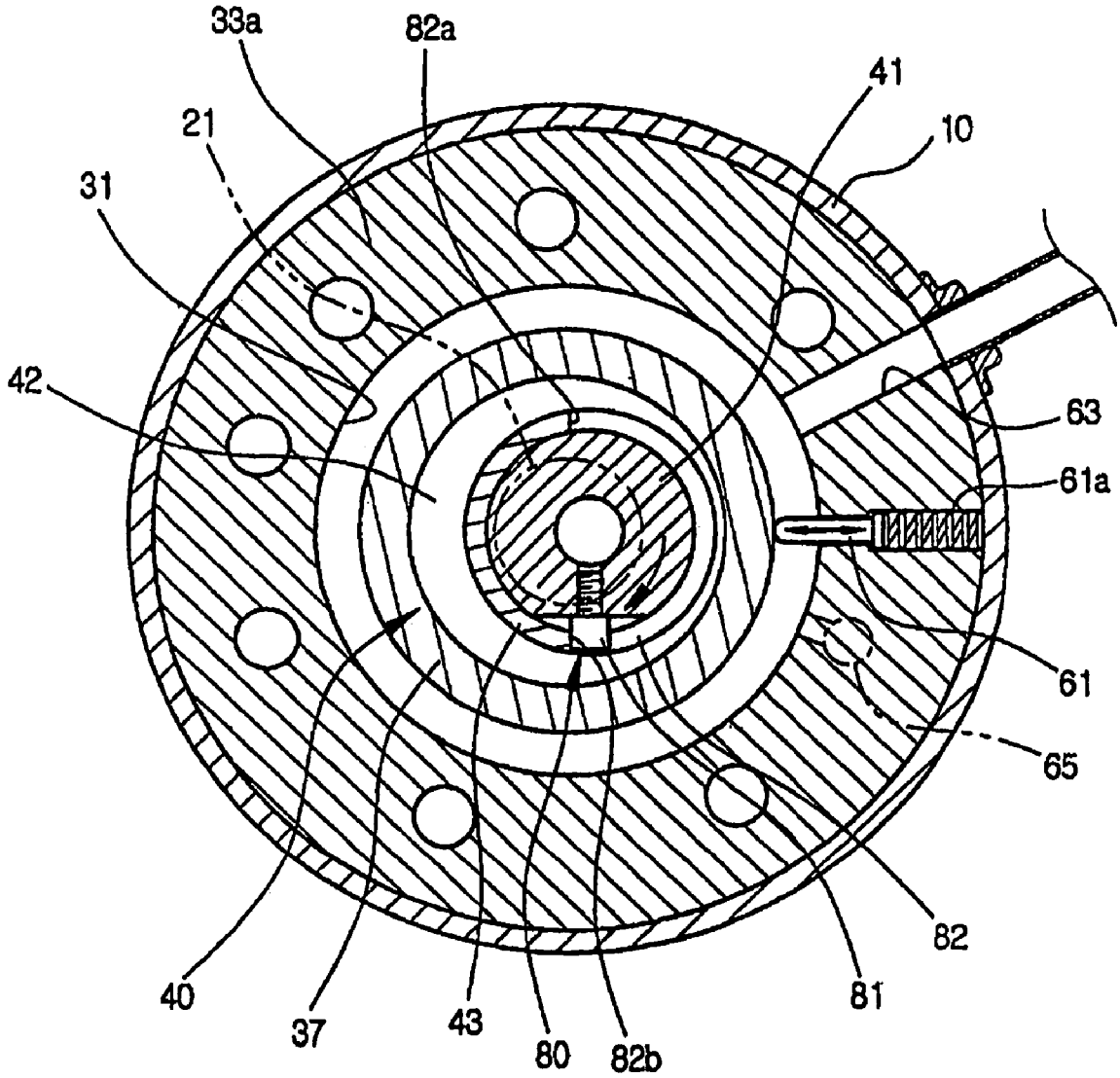
FIG. 5 is a sectional view of the first compression chamber where the idle operation is executed, when the rotating shaft of the variable capacity rotary compressor of FIG. 1 is rotated in a second direction.
Figure 6:
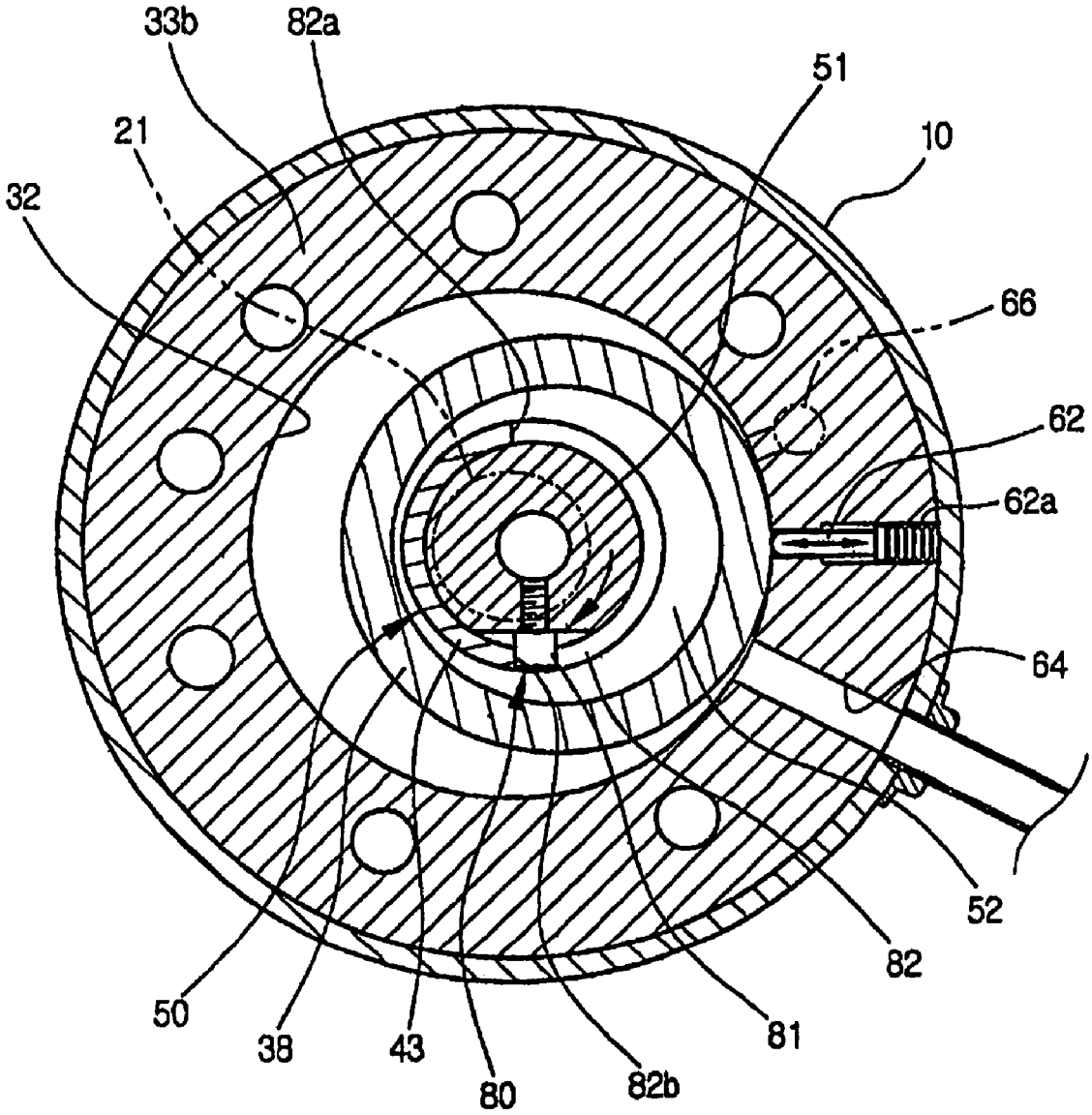
FIG. 6 is a sectional view of the second compression chamber where the compression operation is executed, when the rotating shaft of the variable capacity rotary compressor of FIG. 1 is rotated in the second direction.

When the rotating shaft 21 is rotated in a direction opposite to the direction of FIG. 3 to execute the compression operation, as shown in FIG. 5, the outer surface of the first eccentric bush 42 in the first compression chamber 31 is released from eccentricity from the rotating shaft 21 and the locking pin 81 engages with the locking part 82*b* of the locking slot 82. At this time, the first roller 37 is rotated while being spaced apart from the inner surface of the first compression chamber 31, thus the idle rotation is executed in the first compression chamber 31. Meanwhile, the outer surface of the second eccentric bush 52 in the second compression chamber 32 is eccentric from the rotating shaft 21, and the second roller 38 is rotated while being in contact with the inner surface of the second compression chamber 32, as shown in FIG. 6. At this time, the compression operation is executed in the second compression chamber 32. As such, the variable capacity rotary compressor of the present invention allows the compression operation to be executed in only one of the first and second compression chambers 31 and 32 by changing the rotating direction of the rotating shaft 21, thus easily varying the compression capacity as desired.

As shown in FIG. 1, the variable capacity rotary compressor according to the present invention also includes a path control unit 70. The path control unit 70 controls a refrigerant intake path to make a refrigerant, fed from a refrigerant inlet pipe 69, be drawn into the inlet port 63 of the first compression chamber 31 or the inlet port 64 of the second compression chamber 32, that is, the inlet port of a compression chamber where the compression operation is executed. The path control unit 70 includes a hollow cylindrical body 71, and a valve unit installed in the body 71. An inlet 72 is formed at a central portion of the body 71 to be connected to the refrigerant inlet pipe 69. First and second outlets 73 and 74 are formed on opposite sides of the body 71. Two pipes 67 and 68, which are connected to the inlet port 63 of the first compression chamber 31 and the inlet port 64 of the second compression chamber 32, respectively, are connected to the first and second outlets 73 and 74, respectively. Further, the valve unit includes a valve seat 75, first and second valve members 76 and 77, and a connecting member 78.

The valve seat 75 has a cylindrical shape, and is opened at both ends thereof. The first and second valve members 76 and 77 are installed on both sides in the body 71, and axially reciprocate in the body 71 to open or close both ends of the valve seat 75. The connecting member 78 connects the first and second valve members 76 and 77 to each other to allow the first and second valve members 76 and 77 to move together. In this case, the path control unit 70 is operated as follows. When the compression operation is executed in either of the first and second compression chambers 31 and 32, the first and second valve members 77 set in the body 71 move in a direction toward one of the two outlets 73 and 74 having a lower pressure due to a difference in pressure between the two outlets 73 and 74, thus automatically changing a refrigerant intake path. Thus, the refrigerant intake path is formed in only a compression chambers 31 or 32 where the compression operation is executed, thus easily varying the compression capacity of the compressor as desired.

Figure 7:
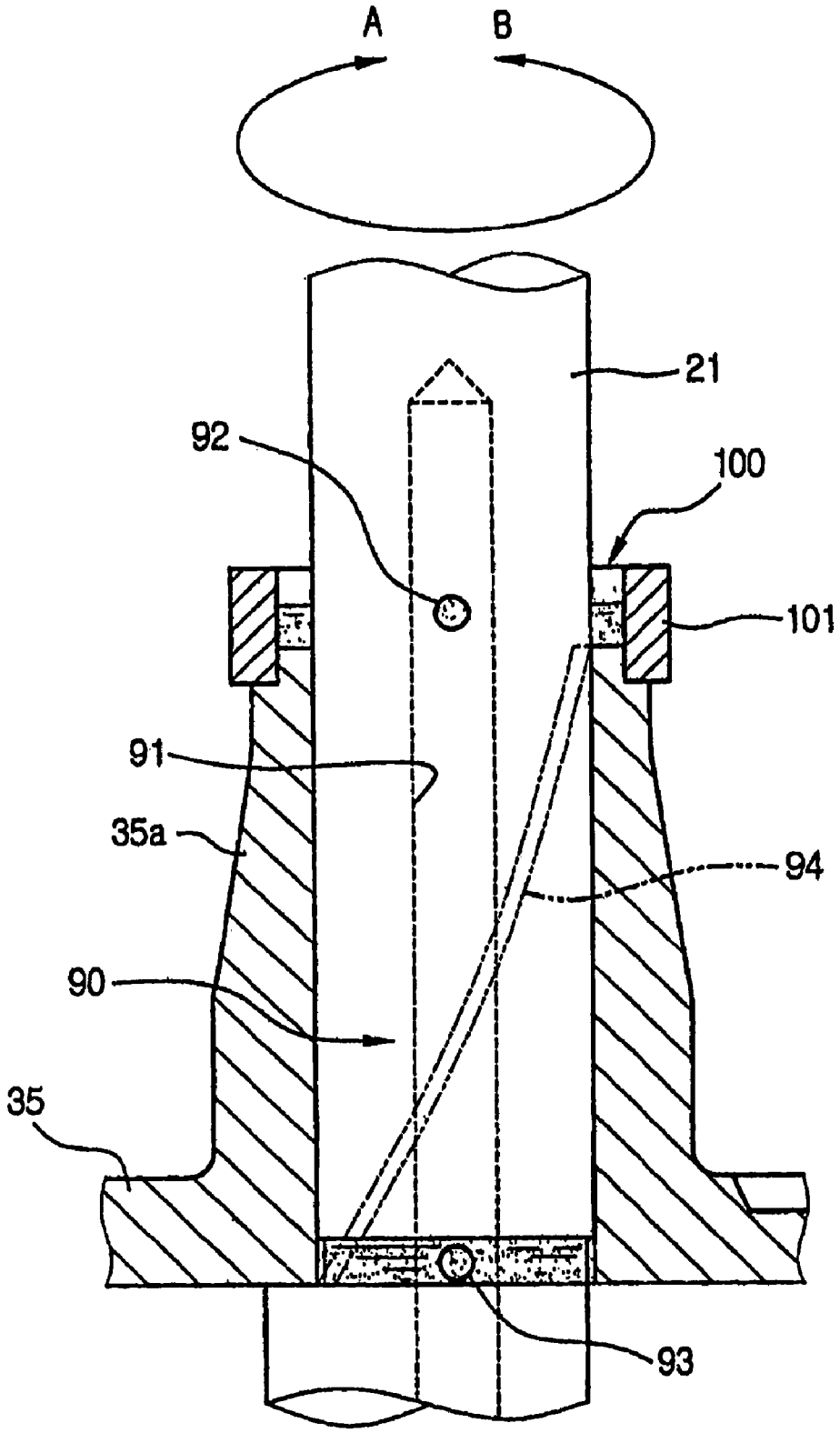
FIG. 7 is a sectional view showing an oil guide unit and an oil storing chamber included in the variable capacity rotary compressor of FIG. 1.

As shown in FIG. 7, variable capacity rotary compressor of the present invention is provided with an oil guide unit 90. When the compressor is operated, the oil guide unit 90 feeds oil to several frictional contact parts, including a junction between the outer surface of the rotating shaft 21 and inner surfaces of the shaft bearings 35*a* and 36*a*, junctions between outer surfaces of the two eccentric cams 41 and 51 and inner surfaces of the two eccentric bushes 42 and 52, and junctions between outer surfaces of the two eccentric bushes 42 and 52 and inner surfaces of the two rollers 37 and 38, thus allowing a smooth operation of the compressor.

As shown in FIG. 1, the oil guide unit 90 functions to feed oil from a lower portion of the hermetic casing 10 to gaps between compressing elements, and the frictional contact parts. The oil guide unit 90 includes an oil passage 91, an oil pickup member 96 to feed the oil to the oil passage 91, a plurality of oil supply holes 92 and 93, and an oil guide groove 94. The oil passage 91 is formed along a central axis of the rotating shaft 21, and is opened at a lower end thereof. The oil pickup member 96 is a spiral blade, which is provided in the lower end portion of the oil passage 91. The oil supply holes 92 and 93 are formed on the rotating shaft 21 in a radial direction thereof to allow the oil passage 91 to communicate with an outer surface of the rotating shaft 21 via the oil supply holes 92 and 93. The oil guide groove 94 is spirally formed on an inner surface of the upper shaft bearing 35*a*. According to the embodiment shown in FIG. 8, the oil guide groove 94 is formed on the inner surface of the upper shaft bearing 35*a*. Alternatively, the oil guide groove 94 may be formed on the outer surface of the rotating shaft 21 to achieve a same operational effect as the oil guide groove 94 formed on the upper shaft bearing 35*a*. The oil guide unit 90 constructed as described above functions to supply the oil, which moves upwardly along the oil passage 91 by a oil lift force generated when the oil pickup member 96 is rotated and a centrifugal force generated when the rotating shaft 21 is rotated at a high speed, to the compressing elements and the frictional contact parts through the oil supply holes 92 and 93.

Figure 8:
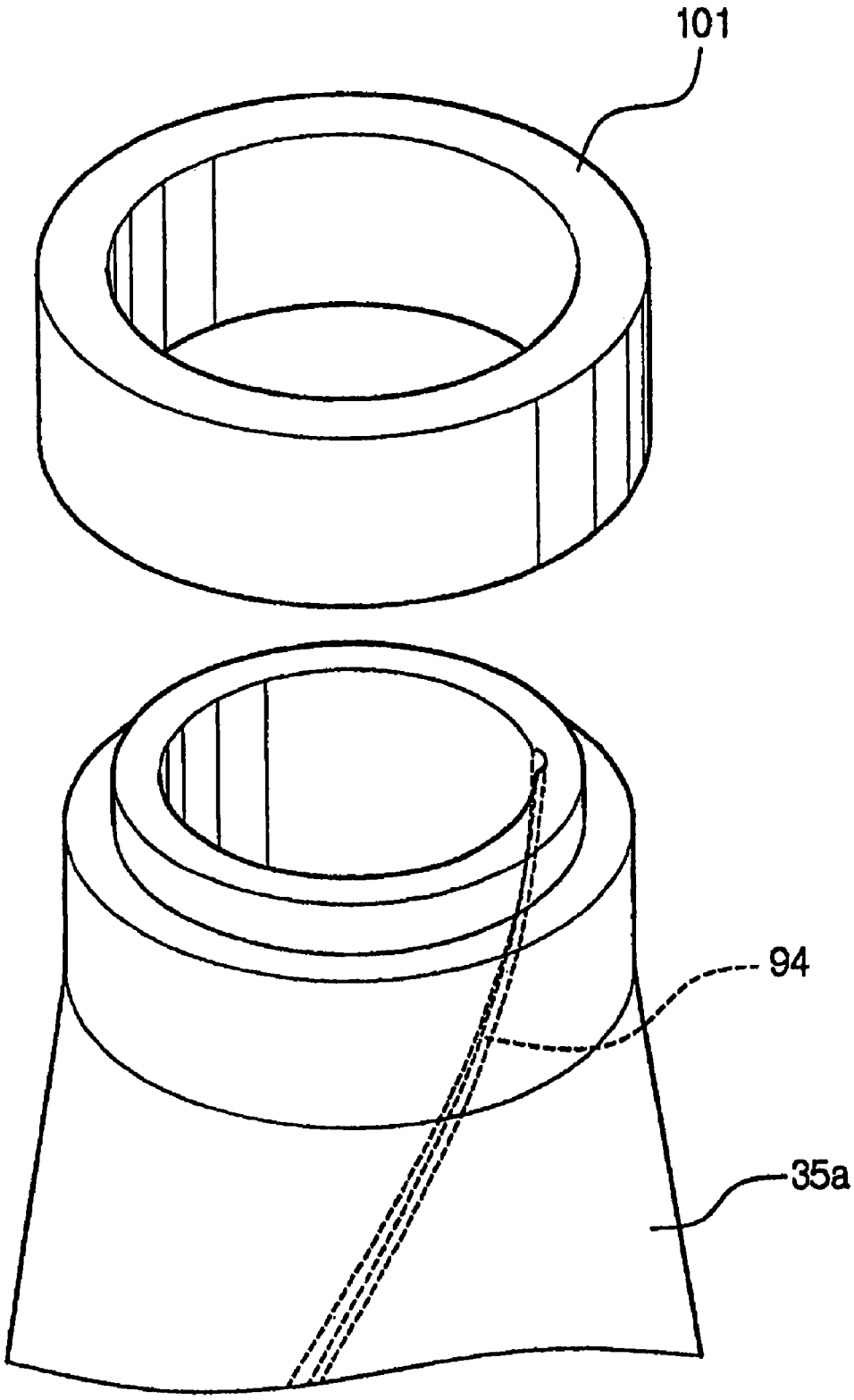
FIG. 8 is a perspective view showing an oil storing member to define the oil storing chamber included in the variable capacity rotary compressor of FIG. 1.

Further, as shown in FIGS. 7 and 8, an oil storing chamber 100 is defined at an upper portion of the upper shaft bearing 35*a* to store a predetermined amount of oil which moves upwardly by the oil guide unit 90, prior to feeding the oil to a lower portion of the compressor. The oil storing chamber 100 has a larger inner diameter than an outer diameter of the rotating shaft 21 to store the oil therein, and is defined by a ring-shaped oil storing member 101 which is mounted at a lower portion thereof to the upper portion of the upper shaft bearing 35*a*.

Figure 9:
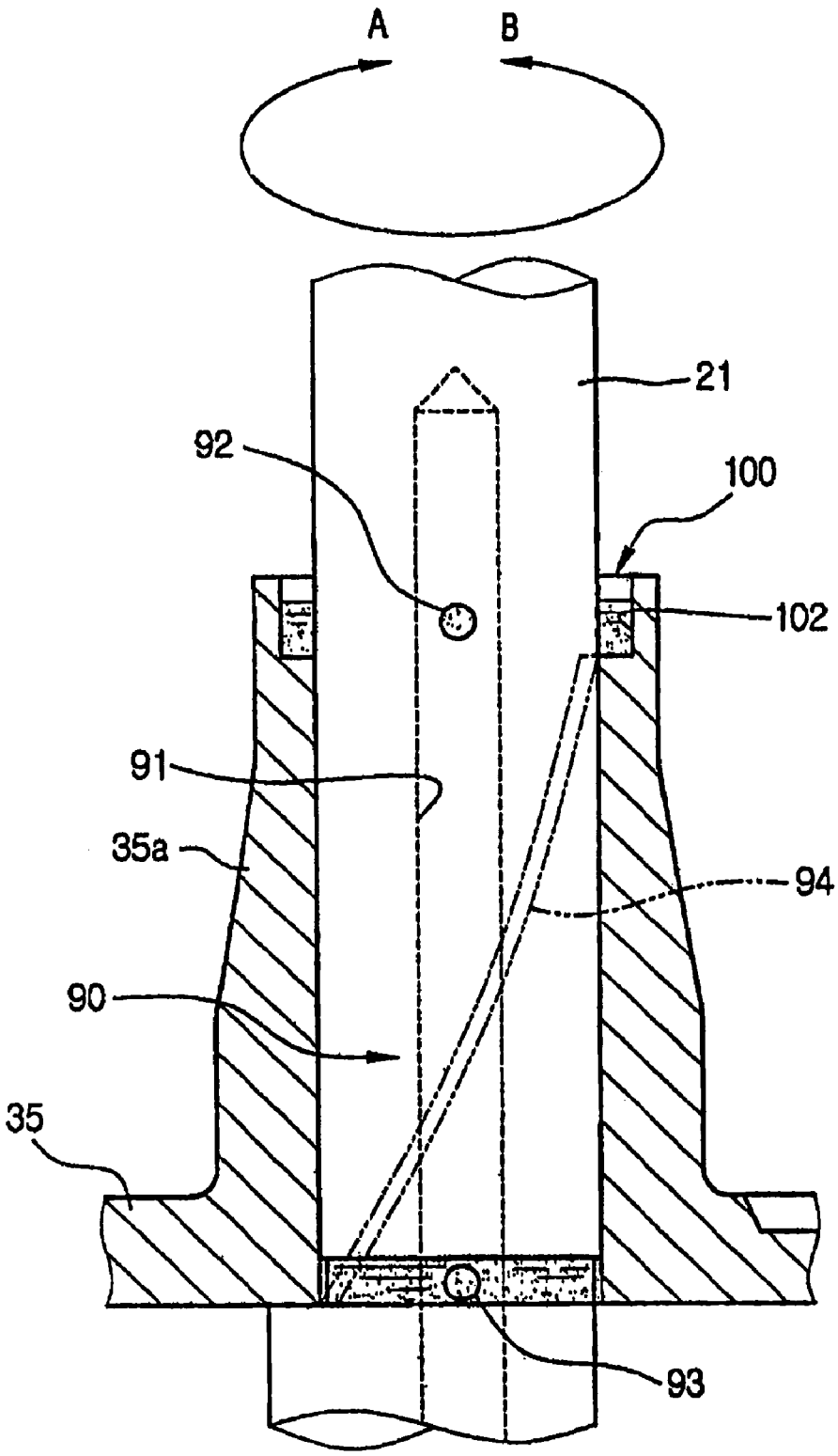
FIG. 9 is a sectional view of an oil storing chamber included in a variable capacity rotary compressor, according to another embodiment of the present invention.

FIG. 9 shows an oil storing chamber 100 defined at the upper portion of the upper shaft bearing 35*a*, according to another embodiment of the present invention. According to the embodiment shown in FIG. 9, the oil storing chamber 100 is directly formed at the upper portion of the upper shaft bearing 35*a* without the oil storing member 101. In a detailed description, the upper shaft bearing 35*a* is machined to have a large inner diameter part 102 at the upper portion of the upper shaft bearing 35*a*, thus defining the oil storing chamber 100 to store oil therein.

As shown in FIGS. 7 and 8, the oil guide groove 94 is spirally formed on the inner surface of the upper shaft bearing 35*a* to communicate with the oil storing chamber 100. Further, a lower oil supply hole 93 is formed on the rotating shaft 21 at a position corresponding to a lower end of the oil guide groove 94, and an upper oil supply hole 92 is formed on the rotating shaft 21 at a position corresponding to the oil storing chamber 100 to be slightly higher than an upper end of the upper shaft bearing 35*a*.

Such a construction allows the oil which tends to flow down under the influence at gravity after spouting from the lower oil supply hole 93 in the radial direction of the rotating shaft 21, to be supplied to the junctions between the eccentric cams 41 and 51 and the eccentric bushes 42 and 52, the junctions between the eccentric bushes 42 and 52 and the rollers 37 and 38, and others, when the rotating shaft 21 is rotated in a direction A of FIG. 7. When the rotating shaft rotates in this direction, some of the oil which spouts from the lower oil supply hole 93, flows upwardly along the oil guide groove 94 formed on the inner surface of the upper shaft bearing 35*a*, and is supplied to the junction between the outer surface of the rotating shaft 21 and the inner surface of the upper shaft bearing 35*a*. The oil guided to the upper portion of the upper shaft bearing 35*a* through the oil guide groove 94, is stored in the oil storing chamber 100. Further, the oil spouting from the upper oil supply hole 92 is stored in the oil storing chamber 100.

Meanwhile, when the rotating direction of the rotating shaft 21 is changed to vary the compression capacity of the compressor, that is, the rotating shaft 21 is rotated in a direction B of FIG. 7, the oil is supplied to the compressing elements while flowing down from the oil storing chamber 100. Thus, the oil is evenly supplied to the junction between the outer surface of the rotating shaft 21 and the inner surface of the upper shaft bearing 35*a*. In this case, since the rotating shaft 21 is rotated in the direction B which is opposite to the direction A, the oil stored in the oil storing chamber 100 is supplied to the compressing elements while being guided downward along the oil guide groove 94, due to the structural characteristics of the oil guide groove 94.

When the rotating shaft 21 has been rotated in the direction B during a predetermined time and the oil stored in the oil storing chamber 100 is exhausted, the oil is newly supplied through the upper oil supply hole 92 to the oil storing chamber 100, and then is guided downward along the oil guide groove 94 while being supplied to the junction between the inner surface of the upper shaft bearing 35*a* and the outer surface of the rotating shaft 21, thus ensuring a smooth operation of the compressor. Further, when the rotating shaft 21 is rotated in the direction B, the oil which spouts from the lower oil supply hole 93, flows down while being supplied to the junctions between the eccentric cams 41 and 51 and the eccentric bushes 42 and 52 and the junctions between the eccentric bushes 42 and 52 and the rollers 37 and 38.

As is apparent from the above description, the present invention provides a variable capacity rotary compressor, which is designed such that a compression operation is selectively performed in one of two compression chambers having different capacities, according to a rotating direction of a rotating shaft, thus precisely varying a compression capacity to obtain a desired exhaust pressure, and easily controlling the compression capacity of the rotary compressor.

Further, the present invention provides a variable capacity rotary compressor, which is designed such that a predetermined amount of oil is stored in an oil storing chamber defined at an upper portion of an upper shaft bearing and the oil is, thereafter, fed to a lower portion of the compressor, thus allowing a smooth supply of oil, regardless of a rotating direction of a rotating shaft.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A variable capacity rotary compressor, comprising:

a rotating shaft to rotate in a forward direction and a reverse direction to vary a compression capacity of the compressor;

a shaft bearing which supports the rotating shaft;

an oil guide groove which is spirally formed on at least one of the shaft bearing and the rotating shaft to supply oil; and an oil storing chamber at an upper portion of the shaft bearing to communicate with the oil guide groove, and to store a predetermined amount of oil therein, wherein the rotating shaft comprises:

an oil passage axially extending from a lower end to a predetermined position of the rotating shaft; and an oil supply hole formed on the rotating shaft in a radial direction to allow the oil passage to communicate with the oil guide groove via the oil supply hole, to feed oil from the oil passage to the oil guide groove.

2. The variable capacity rotary compressor according to claim 1, wherein the oil supply hole is plural in number and formed at positions corresponding to lower ends of the oil guide groove and the oil storing chamber.

3. A variable capacity rotary compressor, comprising:

a rotating shaft to rotate in a forward direction and a reverse direction to vary a compression capacity of the compressor;

a shaft bearing which supports the rotating shaft;

an oil guide groove which is spirally formed on at least one of the shaft bearing and the rotating shaft to supply oil; and an oil storing chamber at an upper portion of the shaft bearing to communicate with the oil guide groove, and to store a predetermined amount of oil therein, wherein the rotating shaft comprises:

an oil passage axially extending from a lower end to a predetermined position of the rotating shaft;

an oil pickup member provided in the lower portion of the oil passage to feed the oil to the oil passage; and an oil supply hole formed on the rotating shaft in a radial direction to allow the oil passage to communicate with the oil guide groove via the oil supply hole, thereby feeding oil from the oil passage to the oil guide groove.

4. A variable capacity rotary compressor, comprising:

a rotating shaft, having an outer cylindrical surface, which is rotated in a clockwise or a counter-clockwise direction;

a shaft bearing, having an inner cylindrical surface in contact with the outer cylindrical surface of the rotating shaft, which supports the rotating shaft in a substantially vertical position;

an oil guide groove which is spirally formed on at least one of the outer cylindrical surface of the rotating shaft and the inner cylindrical surface of the shaft bearing to supply oil to the contacting surfaces; and an oil storing chamber at an upper portion of the shaft bearing to communicate with the oil guide groove, and to store oil therein, wherein the rotating shaft comprises:

an oil passage axially extending from a lower end to a predetermined position of the rotating shaft;

an oil pickup member provided in the lower portion of the oil passage; and an oil supply hole formed on the rotating shaft in a radial direction to allow the oil passage to communicate with the oil guide groove via the oil supply hole, thereby feeding oil from the oil passage to the oil guide groove.

* * * * *

UNITED STATES PATENT AND TRADEMARK OFFICE

CERTIFICATE OF CORRECTION

PATENT NO. : 7,186,100 B2
APPLICATION NO. : 10/811897
DATED : March 6, 2007
INVENTOR(S) : Sung Hea Cho et al.

It is certified that error appears in the above-identified patent and that said Letters Patent is hereby corrected as shown below:

Title Page, Item [56] Column 2, (Foreign Patent Documents), Line 4, change "WO 01/16484" to --WO 01/16485--.

Signed and Sealed this

Tenth Day of July, 2007

JON W. DUDAS
*Director of the United States Patent and Trademark Office*